US009664459B2

(12) United States Patent
Wilding et al.

(10) Patent No.: US 9,664,459 B2
(45) Date of Patent: May 30, 2017

(54) HEAT EXCHANGER WITH A POROUS METAL STRUCTURE HAVING MANIFOLDS AND TUBES

(71) Applicant: AUDI AG, Ingolstadt (DE)

(72) Inventors: Werner Wilding, Walting (DE); Sebastian Schwartze, Ingolstadt (DE)

(73) Assignee: AUDI AG, Ingolstadt (DE)

( * ) Notice: Subject to any disclaimer, the term of this patent is extended or adjusted under 35 U.S.C. 154(b) by 265 days.

(21) Appl. No.: 14/422,126

(22) PCT Filed: Aug. 1, 2013

(86) PCT No.: PCT/EP2013/002294
§ 371 (c)(1),
(2) Date: Feb. 17, 2015

(87) PCT Pub. No.: WO2014/029465
PCT Pub. Date: Feb. 27, 2014

(65) Prior Publication Data

US 2015/0292818 A1 Oct. 15, 2015

(30) Foreign Application Priority Data

Aug. 18, 2012 (DE) ..... 10 2012 016 442

(51) Int. Cl.
*F28F 9/02* (2006.01)
*F28F 13/00* (2006.01)
(Continued)

(52) U.S. Cl.
CPC ..... *F28F 9/02* (2013.01); *F28D 1/05366* (2013.01); *F28F 13/003* (2013.01); *F28F 19/002* (2013.01)

(58) Field of Classification Search
CPC ..... F28F 9/02; F28F 19/002; F28D 1/05366
See application file for complete search history.

(56) References Cited

U.S. PATENT DOCUMENTS 3,129,145 A * 4/1964 Hassler ..... B01D 3/28 159/1.1
3,306,353 A * 2/1967 Burne ..... F28F 1/02 165/164

(Continued)

FOREIGN PATENT DOCUMENTS

CN 2639833 Y 9/2004
CN 201016586 Y 2/2008

(Continued)

OTHER PUBLICATIONS

International Search Report issued by the European Patent Office in International Application PCT/EP2013/002294.

(Continued)

*Primary Examiner* — Ljiljana Ciric
(74) *Attorney, Agent, or Firm* — Henry M. Feiereisen LLC

(57) ABSTRACT

A heat exchanger includes at least two manifolds which are fluidly connected to one another by multiple tubes, and a porous metal structure which at least partially surrounds the tubes. The heat exchanger has a plate-like form with a front side and a rear side. The metal structure is formed by a multiplicity of sheets which are held in each case between two adjacent tubes and, on at least one of the front and rear sides of the heat exchanger, extend across at least one adjacent tube.

12 Claims, 2 Drawing Sheets

(51) Int. Cl.
*F28F 19/00* (2006.01)
*F28D 1/053* (2006.01)

(56) References Cited

U.S. PATENT DOCUMENTS 3,339,260 A * 9/1967 Burne ..... B21D 53/06 165/154
3,385,769 A * 5/1968 Brose ..... B01D 61/362 159/DIG. 27
3,396,782 A * 8/1968 Valyi ..... B22F 7/002 122/33
3,398,091 A * 8/1968 Greatorex ..... B01D 53/22 159/1.1
3,421,994 A * 1/1969 Leduc ..... H01M 8/00 204/219
3,508,312 A 4/1970 Burne
3,508,606 A * 4/1970 Anderson ..... F28D 7/1669 165/145
3,523,577 A * 8/1970 Milton ..... F25J 5/002 165/110
3,587,730 A * 6/1971 Milton ..... F25J 5/005 159/DIG. 28
3,598,180 A * 8/1971 Moore, Jr. ..... F28D 15/046 165/104.26
3,679,372 A * 7/1972 Hartman, Jr. et al. ... G21C 9/00 376/300
3,818,980 A * 6/1974 Moore, Jr. ..... F28D 15/06 165/104.26
4,245,469 A * 1/1981 Fortini ..... F02K 9/64 239/127.1
4,285,385 A 8/1981 Hayashi
4,663,243 A * 5/1987 Czikk ..... C23C 4/02 165/133
4,815,528 A * 3/1989 Shaubach ..... F28D 15/04 122/366
4,846,267 A * 7/1989 Shattes ..... C22F 1/04 165/133
5,329,996 A * 7/1994 Rosenfeld ..... F28F 13/003 165/168
5,693,230 A * 12/1997 Asher ..... B01D 53/22 210/263
5,727,622 A * 3/1998 Gurevich ..... F28F 13/003 165/122
5,823,249 A * 10/1998 Batchelder ..... F28D 9/0025 165/121
5,860,472 A * 1/1999 Batchelder ..... F28F 3/02 165/185
5,867,904 A 2/1999 Harris
5,884,691 A * 3/1999 Batchelder ..... F28F 3/022 165/185
6,284,206 B1 * 9/2001 Lesieur ..... C01B 3/583 165/138
6,293,333 B1 * 9/2001 Ponnappan ..... F28D 15/0233 165/104.26
6,363,217 B1 * 3/2002 Walz ..... H05K 3/3494 392/485
6,793,711 B1 * 9/2004 Sammells ..... B01D 69/141 204/400
6,880,626 B2 * 4/2005 Lindemuth ..... B22F 7/004 165/104.26
6,945,317 B2 * 9/2005 Garner ..... F28D 15/0233 165/104.26
7,327,572 B2 * 2/2008 Erturk ..... F28D 15/043 165/104.33
7,360,581 B2 * 4/2008 Tuma ..... H01L 23/3732 165/185
8,397,798 B2 * 3/2013 Kroliczek ..... F28D 15/0233 122/366
9,279,626 B2 * 3/2016 Berukhim ..... F28F 9/028
2002/0141920 A1 * 10/2002 Alvin ..... B01D 53/22 422/211
2003/0059664 A1 * 3/2003 Menjak ..... H01M 4/8605 429/218.2
2003/0096147 A1 * 5/2003 Badding ..... H01M 8/0271 429/432
2003/0134170 A1 * 7/2003 Sarkar ..... C04B 38/06 429/423
2003/0141046 A1 7/2003 Ikeda
2004/0226702 A1 11/2004 Toonen
2005/0082037 A1 * 4/2005 Thayer ..... H01L 23/3733 165/80.4
2005/0178534 A1 8/2005 Kienbock
2006/0096750 A1 5/2006 Meuzelaar
2006/0166053 A1 * 7/2006 Badding ..... H01M 8/0271 429/429
2008/0099191 A1 * 5/2008 Taras ..... F25B 39/028 165/174
2008/0296008 A1 12/2008 Kim
2010/0230084 A1 9/2010 Luo
2011/0272122 A1 * 11/2011 Corbeil ..... B22F 3/002 165/133
2012/0210581 A1 8/2012 Wallaert
2014/0202673 A1 * 7/2014 Wand ..... F28F 9/0273 165/175
2016/0067138 A1 * 3/2016 Johnson ..... A61B 17/88 601/148

FOREIGN PATENT DOCUMENTS

| | | |
|---|---|---|
| DE | 41 20 442 | 12/1992 |
| DE | 601 24 005 | 6/2007 |
| EP | 0 800 049 | 10/1997 |
| EP | 1 511 969 | 3/2005 |
| EP | 1 553 379 | 7/2005 |
| EP | 1 739 377 | 1/2007 |
| FR | 2 738 625 | 3/1997 |
| JP | S60-294 | 1/1985 |
| JP | 3-31692 A | 2/1991 |
| JP | 2006-028535 | 2/2006 |
| KR | 2001-0029359 | 4/2001 |
| WO | WO 2011/051106 | 5/2011 |

OTHER PUBLICATIONS

Non-Patent-Document: "Metallschäume in der Wärmetechnik".
Chinese Search Report issued on Feb. 4, 2016 with respect to counterpart Chinese patent application 201380043923.9.
BINE Informationsdienst "Metallschäume in der Wärmetechnik" in Projektinfo Dec. 2005, Dec. 2005.
Chinese Search Report issued on Sep. 20, 2016 with respect to counterpart European patent application 201380043923.9.
Translation of Chinese Search Report issued on Sep. 20, 2016 with respect to counterpart European patent application 201380043923.9.

* cited by examiner

HEAT EXCHANGER WITH A POROUS METAL STRUCTURE HAVING MANIFOLDS AND TUBES

CROSS-REFERENCES TO RELATED APPLICATIONS

This application is the U.S. National Stage of International Application No. PCT/EP2013/022294, filed Aug. 1, 2013, which designated the United States and has been published as International Publication No. WO 2014/029465 and which claims the priority of German Patent Application, Serial No. 10 2012 016 442.4, filed Aug. 18, 2012, pursuant to 35 U.S.C. 119(a)-(d).

BACKGROUND OF THE INVENTION

The present invention relates to a heat exchanger with at least two manifolds which are fluidly connected to each other by several tubes, and a porous metal structure which at least partially surrounds the tubes, with the heat exchanger having a plate-like shape having a front side and a rear side.

Such heat exchangers are often used for cooling fluids of a machine, for example an internal combustion engine. The fluid to be cooled flows hereby into one of the manifolds and reaches an opposite manifold via the many tubes. In order to increase the surface area, the tubes are, at least in part, surrounded by a porous metal structure. Air can flow through the heat exchanger in transverse relation to its extension plane to thereby maintain the fluid at moderate temperature in the tubes, in particular to cool it.

The generic EP 1 511 969 B1 discloses a heat exchanger with two manifolds that are fluidly connected to each other by a plurality of tubes, and a porous metal structure which at least partially surrounds the tubes, with the heat exchanger having a plate-like shape with a front side and a rear side. It is disadvantageous that the coating of the individual tubes with the porous metal structure is very complex in terms of the process. Furthermore, reference is made to EP 1 553 379 A1 which shows a heat exchanger with a plurality of flat tubes between which a porous metal structure is arranged. Tubes are exposed on the front side and the rear side of the heat exchanger, so that damage, for example by falling rock, is easily possible.

SUMMARY OF THE INVENTION

Object of the present invention is therefore to provide a robust heat exchanger which is easy to manufacture.

A heat exchanger has at least two manifolds which are fluidly connected to each other by several tubes, and a porous metal structure which at least partially surrounds the tubes, with the heat exchanger having a plate-like shape with a front side and a rear side, and with the metal structure being formed by a plurality of sheets which are respectively held between two adjacent tubes and extend on at least one side of the heat exchanger across at least one adjacent tube.

By forming the porous metal structure, by which the tubes of the heat exchanger are at least partially surrounded, of a plurality of (identical) sheets, which are held between two adjacent tubes and extend on at least one side of the heat exchanger across at least one of the adjacent tubes, the tubes can be provided in a very simple and cost-effective manner with a greatly increased surface area which in addition also protects against damage from outside. The sheets form hereby on the at least one side of the heat exchanger where they extend across the adjacent pipe, a preferably closed facing anteriorly of the tubes to keep particles, entrained by air, away from the sensitive tubes. Foams, nonwoven fabrics, and fine lattice structures of metal are inter alia suitable as metal structure.

According to a preferred embodiment, the sheets extend each on the front side across an adjacent tube. When air flows towards the front side of the heat exchanger and flows out again on the rear side, it is sufficient to have the sheets extend only at the front side across the tubes because it is only there that a significant damage potential exists.

According to a preferred embodiment, the sheets are each configured L-shaped. The L-shaped sheets have a base part which is held by the adjacent tubes, and a leg part which extends across one of the adjacent tubes.

According to a preferred embodiment, the front side of the heat exchanger is anodized. The coating of the leg parts of the sheets with a hard eloxal layer further increases resistance of the heat exchanger and can also produce a pleasing appearance by using different colors of the eloxal coating.

According to a preferred embodiment, the sheets are made of an aluminum alloy. Aluminum is particularly useful because it has a low melting point, is relatively lightweight and cost-effective. According to a particularly preferred embodiment, the aluminum alloy is foamed. A metal foam can particularly easily be shaped into the desired sheet configuration.

According to a preferred embodiment, the tubes are configured as flat tubes. Flat tubes are particularly well suited to lastingly securely fix the sheets between them. The sheets may be additionally also attached to the tubes by a material joint.

A vehicle has at least one heat exchanger according to the invention, which, when installed, can have air flowing against its front side according to a particularly preferred embodiment. In a vehicle, the heat exchanger is used, for example, as a main radiator for an internal combustion engine or air-conditioning condenser. Normally it is arranged at a vehicle front behind a decorative grille. Any particles impacting during travel are reliably captured by the metal structure.

BRIEF DESCRIPTION OF THE DRAWING

Further details and advantages of the invention will become apparent from the following description of a preferred exemplary embodiment with reference to the drawings.

It is shown in the drawings.

DETAILED DESCRIPTION OF PREFERRED EMBODIMENTS

Figure 1:
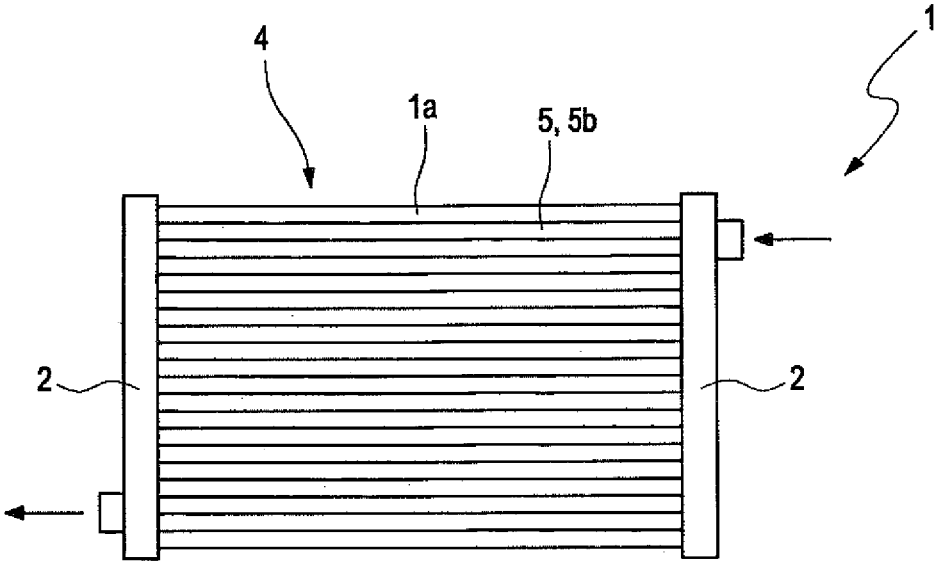
FIG. 1 a perspective view of a heat exchanger.

According to the FIG. 1, a heat exchanger 1 has two opposing manifolds 2 which are fluidly connected by several (here not visible) tubes 3 so that fluid can enter in the one manifold 2 and flow through the tubes 3 to the other manifold 2 to exit there the heat exchanger 1. The tubes 3 are surrounded by a porous metal structure 4 which is formed by a plurality of sheets 5. The sheets 5 are made of metal foam and have an L-shaped configuration with a (here not visible) base part 5*a* and a leg part 5*b*, with the sheets being held with the base part 5*a* between two adjacent tubes 3 and with each leg part 5*b* extending on the front side 1*a* of the heat exchanger 1 across one of the adjacent tubes 3 for protection.

Figure 2:
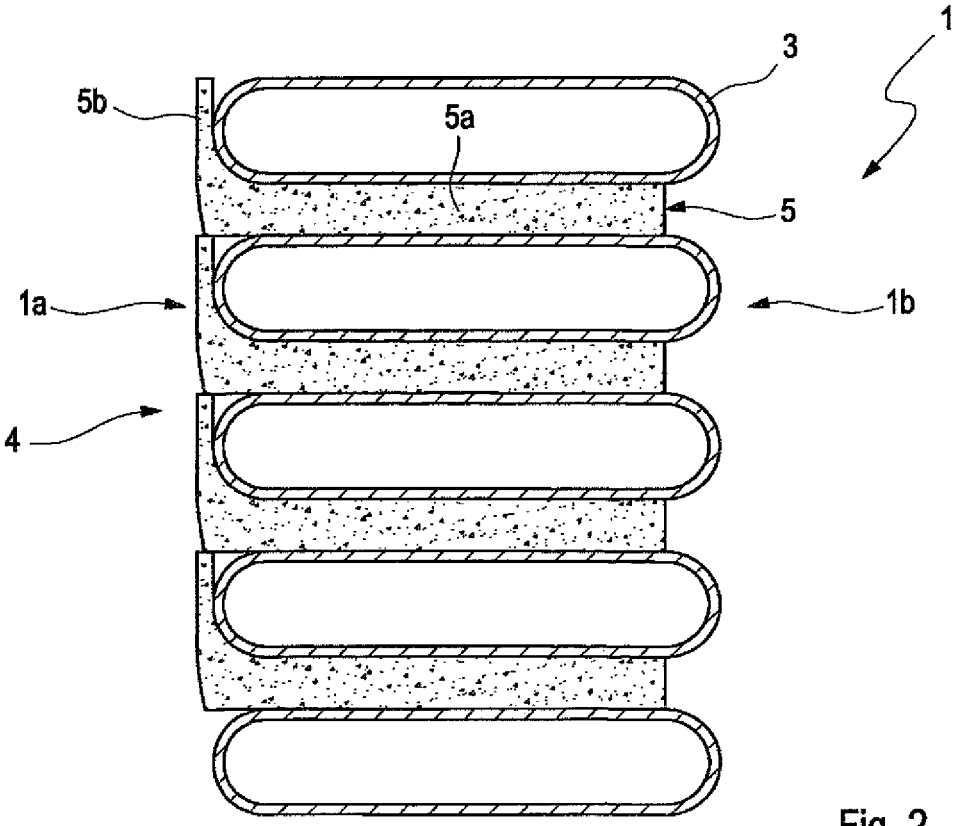
FIG. 2 a sectional view of a heat exchanger.
Figure 3:
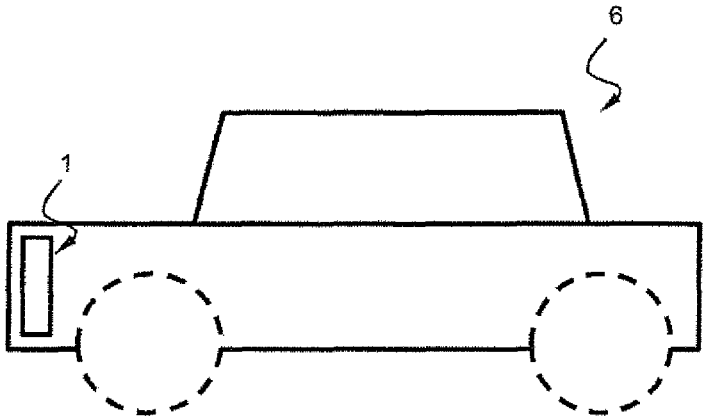
FIG. 3 the vehicle.

In FIG. 2, the union of tubes 3 and sheets 5 is shown again by way of a section. Two adjacent tubes 3 respectively hold the base part 5*a* of a sheet 5 so that the leg part 5*b* is able to extend on the front side 1*a* across one of the adjacent pipes 3. The sheets 5 form the protective metal structure 4 in the union. The leg parts 5*b* may be coated with a hard eloxal layer to further increase the protective effect. The tubes 3 are partly exposed on the rear side 1*b* of the heat exchanger. When installed, air flows through the heat exchanger 1 from the front side 1*a* to the rear side 1*b* thereof.

The invention claimed is:

1. A heat exchanger, comprising:

at least two manifolds;

plural tubes fluidly connecting the manifolds to each other to define a plate-shaped structure with a front side and a rear side, said front side being a foremost part of the heat exchanger and said rear side being a back part of the heat exchanger, wherein the front side is anodized; and a porous metal structure configured to at least partially surround the tubes and including a plurality of sheets respectively held between two adjacent ones of the tubes and extending at least on one of the front and rear sides across at least one of the adjacent tubes, with the sheets forming a closed facing on the at least one of the front and rear sides of the tubes, wherein each of the sheets has an L-shaped configuration.

2. The heat exchanger of claim 1, wherein each of the sheets extends on the front side across the at least one of the adjacent tubes.

3. The heat exchanger of claim 1, wherein the sheets are made of an aluminum alloy.

4. The heat exchanger of claim 3, wherein the aluminum alloy is foamed.

5. The heat exchanger of claim 1, wherein the tubes are configured as flat tubes.

6. A vehicle, comprising at least one heat exchanger having a plate-shaped configuration with a front side and a rear side, said front side being a foremost part of the heat exchanger and said rear side being a back part of the heat exchanger, said heat exchanger including at least two manifolds, plural tubes fluidly connecting the manifolds to each other, and a porous metal structure configured to at least partially surround the tubes and including a plurality of sheets respectively held between two adjacent ones of the tubes and extending at least on one of the front and rear sides of the heat exchanger across at least one of the adjacent tubes, with the sheets forming a closed facing on the at least one of the front and rear sides of the heat exchanger of the tubes, wherein each of the sheets has an L-shaped configuration.

7. The vehicle of claim 6, wherein the heat exchanger, when installed, enables air to flow against the front side.

8. The vehicle of claim 6, wherein each of the sheets extends on the front side across the at least one of the adjacent tubes.

9. The vehicle of claim 6, wherein the front side of the heat exchanger is anodized.

10. The vehicle of claim 6, wherein the sheets are made of an aluminum alloy.

11. The vehicle of claim 10, wherein the aluminum alloy is foamed.

12. The vehicle of claim 6, wherein the tubes are configured as flat tubes.

* * * * *